US006000479A

United States Patent [19]

Ambs

[11] Patent Number: 6,000,479

[45] Date of Patent: Dec. 14, 1999

[54] SLIMHOLE DRILL SYSTEM

[75] Inventor: Loran D. Ambs, Fulshear, Tex.

[73] Assignee: Western Atlas International, Inc., Houston, Tex.

[21] Appl. No.: 09/014,349

[22] Filed: Jan. 27, 1998

[51] Int. Cl.[6] ..... E21B 7/00

[52] U.S. Cl. ..... 175/4.57

[58] Field of Search ..... 175/3.5, 4.55, 175/4.5, 4.57, 4.58

[56] References Cited

U.S. PATENT DOCUMENTS

| | | | |
|---|---|---|---|
| 2,265,982 | 12/1941 | Bolton | 175/4.58 X |
| 2,636,561 | 4/1953 | Harrison | 175/4.58 |
| 2,664,156 | 12/1953 | Allen | 175/4.57 |
| 2,884,836 | 5/1959 | Allen | 175/3.5 |
| 3,070,010 | 12/1962 | Robinson, Jr. | 175/4.5 |
| 4,030,557 | 6/1977 | Alvis et al. | 175/4.5 |
| 4,419,935 | 12/1983 | Shibukawa | 175/4.57 X |

*Primary Examiner*—Frank Tsay
*Attorney, Agent, or Firm*—Alan J. Atkinson

[57] ABSTRACT

A system for drilling a slender borehole through geologic formations. The system comprises a hollow drill pipe having a drill bit for maintaining gauge of the borehole. A pulsed generator such as a homopolar generator provides the power for operating a downhole rail gun. One or more projectiles are accelerated by the rail gun to impact the geologic formations and to extend the borehole length. A plasma generating material is attached to the projectiles to generate a plasma for accelerating the projectiles, and the projectiles can include a secondary explosive for impacting the geologic formations. A controller controls the operation of the rail gun in cooperation with the drill rate to provide interactive control over the firing rate and energy of projectiles impacting the geologic formations.

18 Claims, 2 Drawing Sheets

SLIMHOLE DRILL SYSTEM

BACKGROUND OF THE INVENTION

The present invention relates to the field of drilling boreholes. More particularly, the present invention relates to an improved drill system for generating slender boreholes in geologic formations, and particularly for the purpose of creating geophysical shot holes.

Geophysical seismic operations use explosive charges to generate source signals in the form of shock waves for penetrating subsurface geologic formations. In land-based geophysical seismic operations, slender shot holes several inches in diameter and ranging five to several hundred feet deep are drilled into near surface geologic formations. Explosive charges are positioned within the shot holes, and the explosive charges are detonated to generate the shock waves. The shock waves are reflected from subsurface geologic structures and interfaces, and the reflected energy is detected with receivers or geophones located at the surface. Transducers reduce the reflected energy into signals which are recorded for processing.

Conventional rotary or reciprocating drills can generate shot holes in unconsolidated soils such as topsoil and clay layers. However, conventional drilling equipment is particularly challenged by hard rock. Hard rock drills optimized for hard rock drilling are inefficient in unconsolidated soils because the drill mechanism is fouled by clay materials.

Numerous alternative systems have been developed to generate boreholes in rock. Such systems include water jet assisted drilling, thermal spalling systems, explosive capsule drills, liquid explosive drills, shaped and gauge charges, and combination rotatary and explosive systems. U.S. Pat. No. 3,670,828 to Bennett (1972) used shaped explosive charges detonated by a firing mechanism to impact the geologic formations. U.S. Pat. No. 3,601,061 to Dardick (1971) disclosed a light gas hypervelocity gun. A primary ammunition round having a propellant charge operated in combination with a piston and a secondary ammunition piece. Gas was introduced under pressure into a piston and the primary round was fired.

One tool known as the Tround drilling tool combined a projectile firing gun barrel with a conventional drill bit. The term "Tround" referred to triangular rounds of ammunition and was described in U.S. Pat. No. 3,855,931 to Dardick (1974) as using projectile rounds having a rear chemical propellant charge for accelerating the projectile against the geologic formations. U.S. Pat. No. 4,004,642 to Dardick (1977) described small caliber projectiles fired to generate shock wave interaction, and the utilization of residual gun gases to actuate drill heads and reamers. Mechanical pulverizing teeth pulverized the fractured rock, and this drilling technique increased drilling rates two to five times over conventional drilling systems. A variation of this system was disclosed in U.S. Pat. No. 4,582,147 to Dardick (1986), wherein projectiles were fired away from the tool center to fracture the geologic formations toward one side, thereby causing the drill bit to deflect toward the fractured rock. By controlling the location of the projectile impact relative to the drill head, the direction of the drilling could be controlled.

Another high speed electromagnetically accelerated earth drill was disclosed in U.S. Pat. No. 4,997,047 to Schroeder (1991). Metal ringed, frozen water projectiles were accelerated by a electromagnetic ringing circuit formed with multiple toroidal accelerating coils mounted transverse to the barrel axis. Each projectile included at least two metal rings around the frozen ice core. The multiple accelerating coils were powered with a direct current charger comprising storage batteries charged with a 110 volt battery charger. Alternatively, Schroeder stated that homopolar generators could charge the accelerator coils. The system required multiple timing circuits, projectile position indicators, and variable capacitance storage to effectively phase the coil activations. Alternating polarity between adjacent coils pushed and pulled the projectiles through the barrel.

A recently developed system for breaking rock was disclosed in U.S. Pat. No. 5,474,364 to Ruzzi (1995), wherein shotgun cartridges or other firearm ammunition provided the explosive charge for moving a steel rod to break the rock. In addition to this approach, railgun thrusters have been developed to move projectiles and to generate thrust. U.S. Pat. No. 5,439,191 to Nichols et al. (1995) disclosed a satellite thruster system for generating a high velocity plasma jet. A high energy pulse source was connected to a coaxial or dual-rail accelerator, and a heated propellant plasma was accelerated by a magnetic field. This magnetic field is generated by the rails which generate a "Lorenz" magnetic force perpendicular to the magnetic field on the plasma. The magnetic field accelerates a plasma through the parallel rails in one direction, and the acceleration magnitude depends on the rail length and the current provided.

The power systems for railguns typically comprise capacitor banks, and the wave form for such power is controlled by varying the inductor of the pulse forming network. Current flow through the railgun is induced through electrodes such as rails, creating the electromagnetic field in the railgun bore. Higher current with a shorter discharge duration results in a higher projectile velocity. Additionally, higher current increases the railgun efficiency because the ratio of projectile kinetic energy increase rate to the railgun energy consumed per unit time increases with higher current. The size of the power source and desired thrust performance are relevant to the successful application of railguns to a particular use.

Conventional systems for drilling a borehole through geologic formations such as hard rock have been limited by various factors. The narrow confines within a slender borehole significantly limits downhole placement of equipment and power systems. There is, accordingly, a need for an improved system capable of drilling a slender borehole through subsurface geologic formations. The system should be transportable into remote areas and should efficiently generate a borehole through unconsolidated soils and hard rock.

SUMMARY OF THE INVENTION

The invention provides a system for drilling a slender borehole through geologic formations until the borehole end reaches a selected location. The invention comprises a hollow drill pipe having a lower end extending into the borehole end, a drill bit attached to said drill pipe lower end, a projectile, and a pulsed generator. A rail gun having at least two substantially parallel electrodes separated by an electrode gap is engaged with the pulsed generator for accelerating each of said projectiles through said electrode gap and into contact with the geologic formation to form debris. The debris is removed from the borehole end by a means for introducing compressed air into said drill pipe interior and by venting the compressed air from the rail gun muzzle for entraining drill cuttings and for transporting such cuttings to the surface through the annulus between the drill pipe and wellbore.

In different embodiments of the invention, the drill bit is movable to maintain gauge of the borehole, the pulsed generator can be placed adjacent to the lower end of the drill pipe, a plasma generating material can be attached to one side of the projectile, and the projectile can comprise a secondary explosive. A magazine can be engaged with the rail gun for providing a plurality of projectiles to the rail gun, and a controller can be engaged with the drill pipe and with the rail gun for monitoring the drill rate and for operating the rail gun in response to the drill rate.

DESCRIPTION OF THE PREFERRED EMBODIMENTS

The invention utilizes the energy from an accelerated projectile to impact and to pulverize geologic formations. The invention provides for the creation of a borehole through the geologic formations, and is particularly useful in mixed geology and in slender boreholes having a relatively small operating volume.

Figures 1, 4:
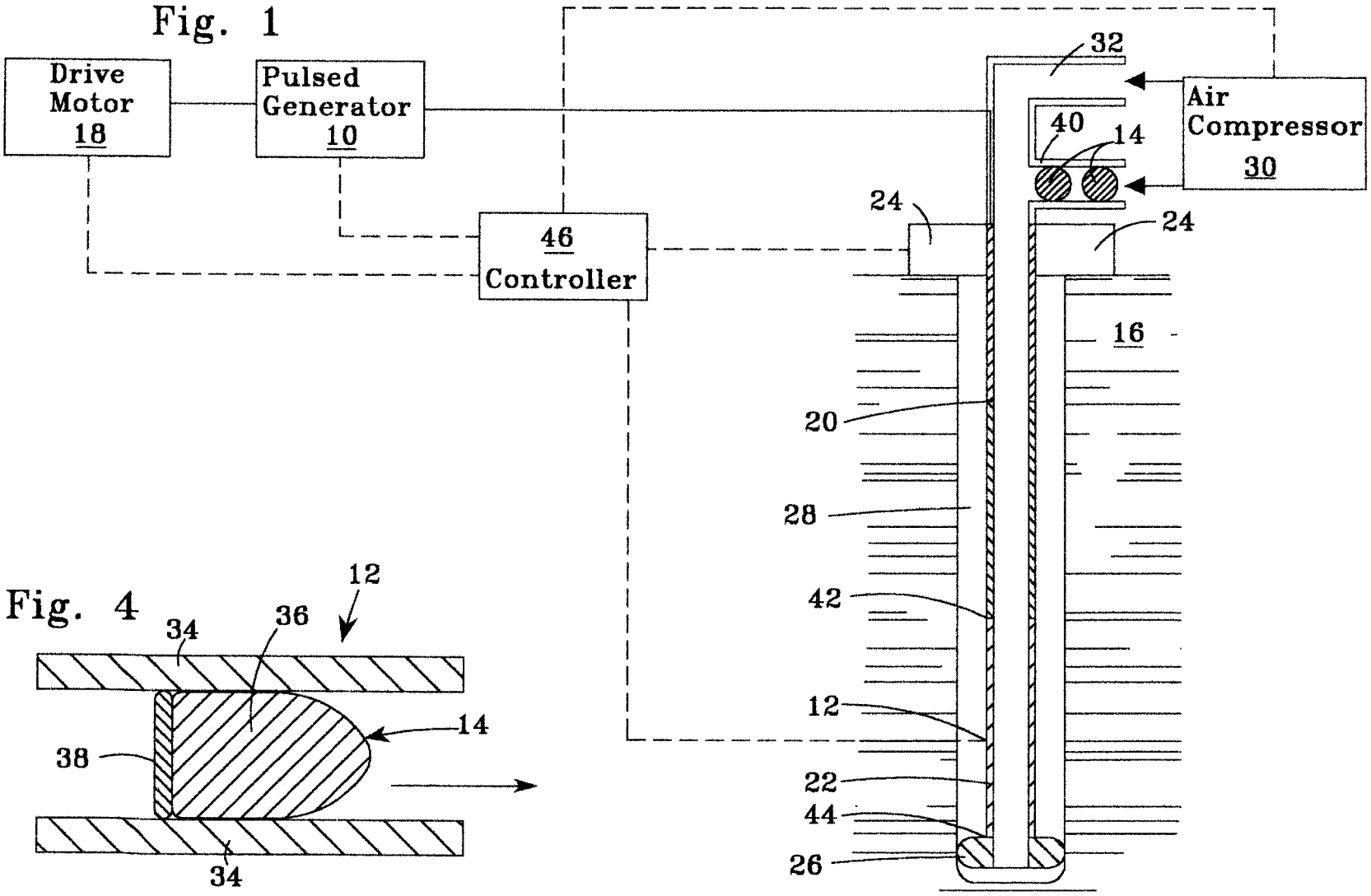
FIG. 1 illustrates a schematic diagram for a pulsed generator in combination with a rail gun for accelerating projectiles to generate a slender borehole.
FIG. 4 illustrates one embodiment of a projectile attached to a plasma generating material.
Figure 2:
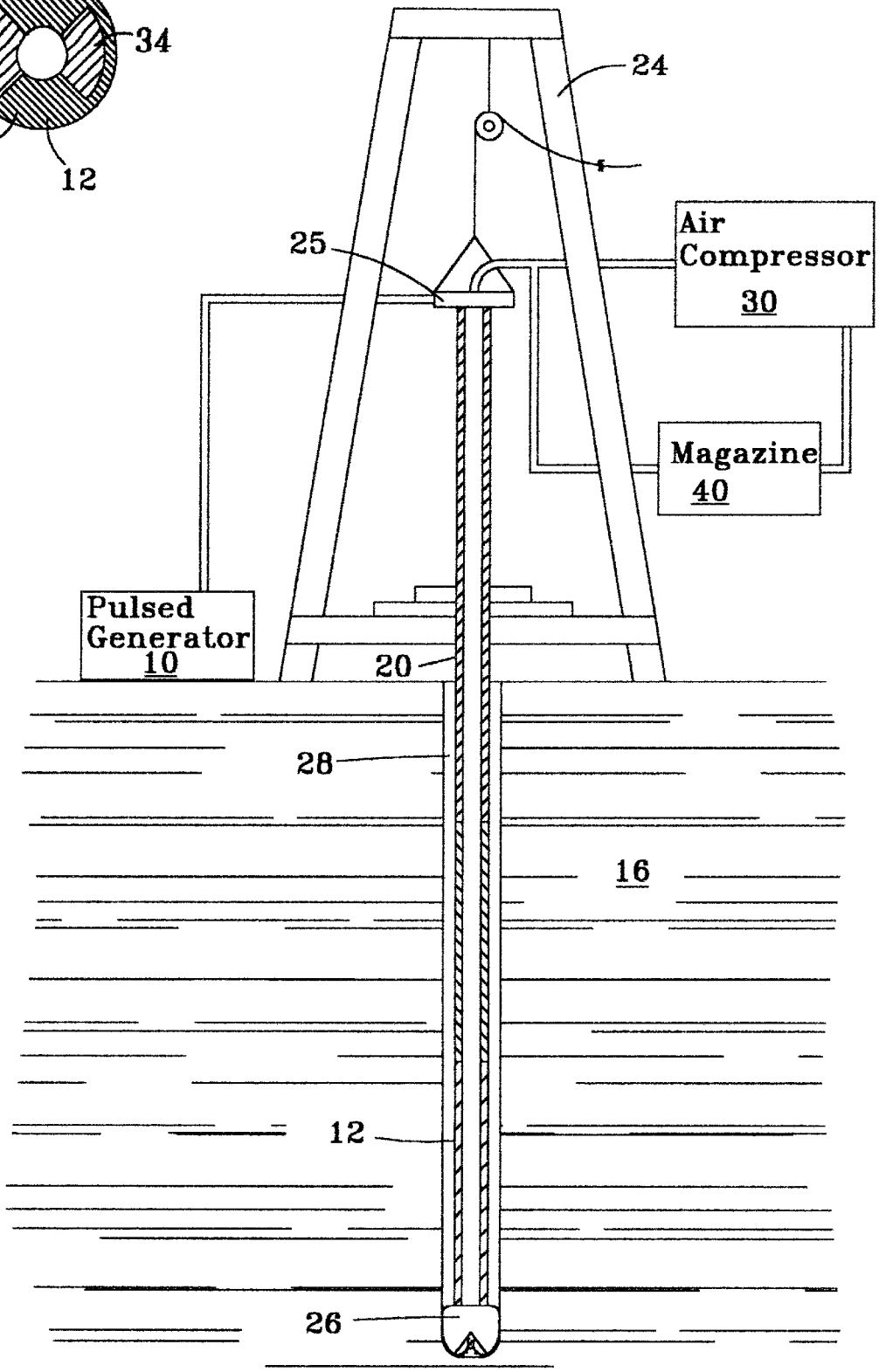
FIG. 2 illustrates one form of drilling rig for supplying projectiles and compressed air to the drill system.

FIG. 1 illustrates a representative schematic diagram for one embodiment of the invention. Pulsed generator 10 is engaged with rail gun 12 to accelerate projectile 14 into contact with geologic formations 16. Pulsed generator 10 is powered with drive motor 18 as described below, and can be located downhole or at the surface as schematically illustrated in FIG. 1. Rail gun 12 is attached to drill pipe 20 having a hollow interior and having lower end 22 extending downwardly into geologic formations 16. Drill pipe 20 can be rotated and reciprocated with drilling rig 24 as more clearly illustrated in FIG. 2. Drilling rig 24 can comprise a fixed tower or can be mounted on a portable base transported by a truck, vessel, or helicopter. Drill bit 26 is attached to drill pipe lower end 22 for maintaining gauge of borehole 28 through geologic formations 16, for pulverizing debris in the end portion of borehole 28, or for providing direction in the advancing path of borehole 28. Drill bit 26 can be rotated or reciprocated as drill pipe 20 is operated by drilling rig 24. Drilling rig 24 can incorporate swivel 25 for permitting rotation of drill pipe 20 while supplying power from pulsed generator 10, compressed air and projectiles 14 to the interior of drill pipe 20 and attached rail gun 12. Alternatively, drilling rig 24 can comprise a downhole motor for operating a rotatable drill bit 26 with conventional hydraulic, pneumatic, or mechanical techniques. Air compressor 30 supplies compressed air to the interior of drill pipe 20 through hose 32. In place of compressed air, a debris removal means such as compressor 30 can supply gases other than compressed air to remove the geologic formation 16 cuttings and to cool operable components of the system.

Each projectile 14 is accelerated through a drill pipe section comprising rail gun 12 powered with a high current and low voltage pulsed generator 10. Projectile velocities exceeding two kilometers per second can be achieved with rail gun 12. As used herein, the term "pulsed generator" comprises different devices identified as homopolar generators and compensated pulsed alternators. These devices store energy in a rotating component and are capable of converting kinetic energy into electric energy. Extracting energy from the device slows or stops the rotor or flywheel. After the energy is discharged, the rotating component is recharged to the original rotational velocity with drive motor 18. Depending on the configuration, mass and rotational velocity of the rotating component, the recharging can be accomplished within seconds or minutes. For certain types of pulsed generators or combinations of generators, pulsed power can be generated continuously within the system to permit the firing of up to hundreds of shots per second. In a preferred embodiment of the invention, a single shot per second is contemplated to permit sufficient time for debris removal before the next shot.

Figure 3:
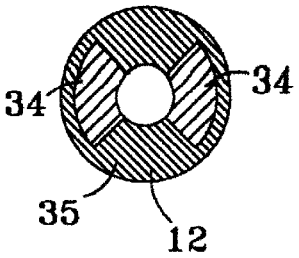
FIG. 3 illustrates one form of electrode assembly within a rail gun.

FIG. 3 illustrates one configuration of electrodes 34 within rail gun 12. Electrodes 34 are positioned on opposite sides of rail gun body 35 and can be run in a straight or helical manner through rail gun body 35. Electrodes 34 similarly extend through drill pipe 20, except that electrodes are electrically insulated from each other and the inner and outer walls of drill pipe 20 in all portions except the portion identified as rail gun body 35. Alternatively, electrodes 34 can be attached to an electrical conductor for transmission of energy between pulsed generator 10 and electrodes 34.

Projectiles 14 are lowered within the interior of drill pipe 20 until each projectile 14 is engaged with rail gun 12. When projectile 14 enters the gap between electrodes 34 for rail gun 12, electrodes 34 cooperate to form a magnetic force perpendicular to the length of electrodes 34. Current flowing across the electrode gap produces a magnetic field at right angles to the electrode 34 field. Such force accelerates projectile 14 through the gap between electrodes 34 and into contact with geologic formations 16. If projectile 14 is an electrically conductive material, projectile 14 provides the conductivity path to short between electrodes 34.

In one embodiment of the invention as illustrated in FIG. 4, projectile 14 can comprise a ceramic core 36 having a thin coating 38 of an electrically conductive material such as a foil or bonded metallic layer. Materials other than ceramic can be utilized for core 36. Coating 38 comprises a plasma generating material and can be positioned on a portion of projectile 14 rearward of the direction of travel of projectile through rail gun 12. In other embodiments of the invention, coating 38 can be positioned in various positions and configurations relative to core 36. When projectile 14 is engaged between electrodes 34, electrical current between electrodes 34 and through coating 38 generates a plasma behind ceramic core 36 which is acted upon by electrodes 34 to accelerate the plasma and projectile 36 through rail gun 12. Alternatively, plasma generating material 38 does not have to be attached to projectile 14 and can be introduced into the gap between electrodes 34 in other ways known in the art.

By using projectiles primarily formed with ceramic cores, the projectile 14 debris formed from such impact is removable from borehole 28. The absence of propellants used in conventional propellant shells eliminates the noxious gases remaining after discharge. The absence of metal projectiles eliminates heavy metal residue in the debris which can further contaminate borehole 28 and the debris removed from borehole 28. Because ceramic is a hard, brittle material which tends to shatter upon impact, the residue from an impacted ceramic projectile 16 is easily removed from borehole 28 with compressed air or other techniques familiar to those skilled in the art. However, other materials such as plastics, composites, metals, and inorganic or organic materials can be used to provide core 36 for projectiles 14.

Air compressor 30 provides a means for cleaning debris from the end of borehole 28 and can also provide a means for cooling system components such as rail gun 22. As a projectile 14 impacts the portion of geologic formations 16 in the path of borehole 28, energy from moving projectile 14 acts against the material forming geologic formations 16. If such material comprises topsoil or relatively soft formations, the kinetic energy of projectile 14 is sufficient to displace earth materials from the bottom of borehole 28 and to extend the length of borehole 28. If such earth material comprises an alluvial stone or a hard rock layer, the kinetic energy of projectile 14 erodes and weakens the hard rock by creating microfissures or by otherwise vibrating the hard rock to weaken the physical bonds within such rock. Repeated impacts against such rock may be sufficient to shatter or pulverize the hard rock for extending the depth of borehole 28.

In a preferred embodiment of the invention, projectile 14 can comprise a secondary explosive which detonates upon impact with geologic formations 16. Secondary explosives are relatively safe to transport and handle, deliver large amounts of energy upon detonation, and do not leave significant residue within borehole 28 after detonation.

The debris created by projectile 14 impacting geologic formations 16 is removed from borehole 28 by compressed air transmitted to the borehole end through the hollow drill pipe 20 interior. The compressed air removes debris from rail gun 12 and cools rail gun 12 between successive shots. As previously described, other gases or fluids can be used in place of compressed air to remove geologic formation 16 debris.

Projectiles 14 can be loaded into drill pipe 20 for transmission to rail gun 12 with compressed air, or for storage in magazine 40. Magazine 40 can be located at the surface as shown in FIG. 1 or can be located downhole proximate to drill pipe 20 or to rail gun 12. As shown in FIG. 1, each projectile 14 can be moved with compressed air to reach the gap between electrodes 34. When the projectile reaches the exposed electrodes 34 of rail gun 12, the projectile 14 is accelerated by the large electromagnetic forces produced by the transmission of current through the projectile 14 or plasma and along rail gun electrodes 34.

As illustrated in FIG. 4, dual rail railgun 12 comprises a pair of substantially parallel electrodes 34. If a plasma is used as the conductive path, the spacing between electrodes 34 define the initiation gap through which a plasma jet is accelerated. The plasma is accelerated from the initiation end 42 to the muzzle end 44 of rail gun 12, and is accelerated unidirectionally by the electromagnetic force exerted by electrodes 34. The ratio of the length of electrodes 34 to the separation gap between electrodes 34 defines an aspect ratio which affects the terminal velocity of projectile 14 before impact.

The amount of acceleration acting on projectile 14, and the mass and physical properties of projectile 14 can be varied to fit penetration and pulverization characteristics of various geologic formations encountered. The firing rate can range up to one hundred projectiles per second, however the preferred embodiment of the invention uses a rate approximately one projectile per second. This firing rate permits the shot blast residue and pulverized rock material to be removed from the distal end of borehole 28 before the next projectile 14 is fired.

The pulverizing rate depends on the projectile mass, shape, mechanical properties, velocity, and on the unconfined compressive strength and composition of the geologic formation impacted. In one embodiment of the invention, projectiles 14 have an unconfined compressive strength equal to or greater than the unconfined compressive strength of the geologic formation. For hard rock penetration, the theoretical penetration rate of an explosive-capsule system exceeds 100 ft/minute in granite. If the actual penetration rate through hard rock was 0.5 feet per shot, at a frequency of one shot per second, rock penetration rates of thirty feet per minute could be attained.

Controller 46 is engaged with pulsed generator 10 and with rail gun 12 to control the operation of such components. Controller 46 controls the firing rate of projectiles 14, and controls the amount of power transmitted to rail gun 12. In a preferred embodiment of the invention, controller 46 monitors the hardness of the geologic formations 16 and adjusts the system operation in response to such hardness. The hardness or composition of the geologic formations 16 can be monitored through drilling rig 24 by determining the penetration rate through geologic formations, and can be monitored though other techniques such as the weight on drill bit 26 or with sensors located within the system or with local geologic information preprogrammed into controller 46.

If drill bit 26 encounters relatively soft geologic formations such as topsoil, clay or friable shale, projectiles 14 may comprise a light weight ceramic material. If the drill encounters hard rock, the controller may select a more massive projectile 14, higher current levels, or projectiles 14 comprising secondary explosives can be introduced into rail gun 12 until the hard rock obstruction or layer is penetrated. In this manner, controller 46 offers significant flexibility in controlling the penetration power of the system in response to changing geologic conditions. Projectiles 14 comprising secondary explosives may not detonate upon impact in soft geologic, and the detonation of secondary explosives in soft soils may excessively crater borehole 28 by creating too large of an opening. For this reason, controller 46 provides unique system flexibility in adjusting the penetrating power of projectiles 14 to the local geologic conditions.

The system accomplishes the desired result by transmitting fracturing energy to the rock at the borehole end, by removing the rock residue, and by maintaining borehole stability. The system is highly effective because it offers demonstrated penetration rates, performance can be maintained at depth, gauge of the borehole is maintained without excessive cratering of the borehole. The ignition and firing order of the system is simple, reliable, controllable, and safe. Moreover, the energy imparted by the system can be adjusted to the hardness and composition of the geologic formations.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A system for drilling a slender borehole through geologic formations until the borehole end reaches a selected location, comprising:

a hollow drill pipe having a lower end extending into the borehole end;

a drill bit attached to said drill pipe lower end;

a plurality of projectiles;

a pulsed generator;

a rail gun having substantially parallel electrodes separated by an electrode gap and engaged with said pulsed generator for accelerating each of said projectiles through said electrode gap and into contact with the geologic formation to form debris as the borehole depth is extended; and a means for introducing compressed gas into said drill pipe interior for removing debris from the borehole.

2. A system as recited in claim 1, wherein said drill bit is movable to maintain the gauge of the borehole.

3. A system as recited in claim 1, wherein said pulsed generator is positioned adjacent the lower end of said drill pipe.

4. A system as recited in claim 1, further comprising a plasma generating material attached to one side of said projectile.

5. A system as recited in claim 1, wherein said debris removal means introduces compressed air transported into the borehole to cool said rail gun and to transport the debris away from the borehole end.

6. A system as recited in claim 5, wherein said compressed air is transported into the borehole through said hollow drill pipe.

7. A system as recited in claim 6, wherein the debris is transported away from the borehole end through the annulus between said drill pipe and the borehole.

8. A system as recited in claim 1, wherein said projectile has a core formed with a secondary explosive.

9. A system as recited in claim 1, further comprising a magazine engaged with said rail gun for providing a plurality of projectiles to said rail gun.

10. A system as recited in claim 1, further comprising a controller engaged with said drill pipe and with said rail gun for monitoring the drill rate of said drill bit and for controlling the operation of said rail gun in response to said drill rate.

11. A system as recited in claim 10, wherein said controller detects the hardness of the geologic formation proximate to said drill bit and manages the operation of said rail gun in response to the geologic formation hardness.

12. A system for drilling a slender borehole through geologic formations until the borehole end reaches a selected location, comprising:

a hollow drill pipe having a lower end extending into the borehole end;

a drill bit attached to said drill pipe lower end;

a plurality of projectiles;

a pulsed generator;

a rail gun having at least two substantially parallel electrodes separated by an electrode gap and engaged with said pulsed generator for generating a plasma from a plasma generating material and for accelerating each of said projectiles through said electrode gap and into contact with the geologic formation to form debris as the borehole depth is extended; and an air compressor for introducing compressed air into said drill pipe interior for removing debris from the borehole.

13. A system as recited in claim 12, wherein said plasma generating material is attached to said projectiles.

14. A system as recited in claim 12, further comprising a magazine for storing said projectiles and for introducing said projectiles into engagement with said rail gun.

15. A system as recited in claim 12, further comprising a controller for managing the operation of said rail gun.

16. A system as recited in claim 15, wherein said controller is capable of determining the drill rate of said rail gun and is capable of managing the operation of said rail gun in response to said drill rate.

17. A system as recited in claim 12, wherein said projectiles have an unconfirmed compressive strength equal to or greater than the unconfirmed compressive strength of the geologic formations.

18. A system as recited in claim 17, wherein said projectiles comprise secondary explosive attached to said plasma generating material.

* * * * *